United States Patent [19]

Seeger

[11] Patent Number: 4,738,543

[45] Date of Patent: Apr. 19, 1988

[54] DEVICE FOR MIXING AND DISPERSION OF AT LEAST TWO MEDIA

[75] Inventor: Hanspeter Seeger, Ballrechten-Dottingen, Fed. Rep. of Germany

[73] Assignee: Ystral GmbH, Dottingen, Fed. Rep. of Germany

[21] Appl. No.: 863,702

[22] Filed: May 15, 1986

[30] Foreign Application Priority Data

May 15, 1985 [DE] Fed. Rep. of Germany ..... 3517655

[51] Int. Cl.[4] ..... B01F 5/12

[52] U.S. Cl. ..... 366/264; 366/307

[58] Field of Search ..... 366/264, 270, 306, 307, 366/265; 415/81, 83, 84

[56] References Cited

U.S. PATENT DOCUMENTS

| | | | |
|---|---|---|---|
| 2,875,897 | 3/1959 | Booth | 366/264 |
| 2,985,389 | 5/1961 | Willems | 366/264 |
| 3,724,765 | 4/1973 | Rohrbaugh | 366/264 |
| 3,912,236 | 10/1975 | Zipperer | 366/264 |

*Primary Examiner*—Robert W. Jenkins

*Attorney, Agent, or Firm*—Wood, Dalton, Phillips, Mason & Rowe

[57] ABSTRACT

The invention is concerned with a device for the mixing and dispersion of at least two media, the device consisting of a substantially tubular stator (4) with at least one substantially axial inlet (12) and a substantially axial discharge (15) for the media and a rotor (2) with several radially extending rotor blades (5), the rotor being arranged in the stator (4), coaxially to it, between the inlet (12) and the discharge (15). In order that a partial stream of the media, which are at least premixed, be dispersed reliably, the stator (4) has radial openings (16) in the region of the rotor (2).

10 Claims, 2 Drawing Sheets

DEVICE FOR MIXING AND DISPERSION OF AT LEAST TWO MEDIA

The invention is concerned with a device for mixing and dispersion of at least two media.

A device of this type of construction is described and presented in U.S. Pat. No. 4,437,765. The device according to the art is a guided jet mixer in which the media are mixed as a result of the rotation of the rotor and of the circulation that is also based on the rotation of the rotor. In the known mode of execution, the essential result is a mixing process. Although dispersion is possible due to the presence of individual dispersing elements, recirculation is adversely influenced by the dispersion of the material and so is the rate of recirculation because the dispersion occurs in the main stream. Thus, the dispersion effect is incomplete.

The purpose of the invention is to design a device with the type of construction indicated at the outset, so that dispersion can be applied reliably to a partial stream of the media that are at least premixed.

The essential advantage of the mode of execution according to the invention consists in the fact that it makes it possible to perform simultaneous mixing and dispersion without mutual hindrance. These two processes are not integrated within a stream but they are carried out on a partial stream, whereby the dispersion stream is directed radially, based on the centrifugal force of the parts of the mixture set into rotation by the rotor. Thus, the radial acceleration of the at least premixed components is utilized for the more intense process step of the device, namely dispersion, in which the media present in the partial stream are broken down and finely divided with the aid of the radial acceleration.

That is, during the operation of the device, two mixture streams leave the device continuously, namely the dispersed partial stream and the partial stream that was mixed in the conventional manner. In this way, by determining the mixing time, the amount of dispersion work and mixing work can be varied and adapted to the purpose. This is not possible either with a pure dispersion machine or with a jet mixer.

The amount of dispersion work and mixing work can be determined by the dimension of the discharge opening. This depends on the degree of dispersion and on the nature of the media to be treated. This size can be set for certain media so that it is unchanged or it can be variable continuously or in a stepwise manner so that it can be adapted to different media and/or different mixing or dispersion results.

Within the invention, the size of the discharge opening for the mixed partial stream may assume relatively small values, and, under certain circumstances, the discharge opening can even be completely closed, so that only the dispersed partial stream leaves the stator exclusively through the openings for this partial stream. This applies especially in the presence of openings for the dispersed partial stream arranged in a corner region of the stator therefore extending partly radially and axially.

The design according to the invention is of special importance for all processes, which begin with the use of a powder and require during the subsequent treatment separation of the materials to be treated without clumps or agglomerates. The same applies for emulsification processes in which first a coarse emulsion is formed and then this emulsion is made finer by further mixing of the dispersed phase and depending on the duration of the processing, so that it remains stable. The conventional dispersion systems have the disadvantage that, although they emulsify satisfactorily, do not provide the recirculating work for drawing in a powder or other light materials. This means that, especially in the critical phase, namely, toward the end of the wetting process, when the viscosity is already high, clumps of powder float to the surface and these can no longer be pulled in and dispersed. In this case, very frequently, an additional stirring element must be introduced so that the process can be completed. In such a case, namely when a relatively large drawing-in effect is needed for the material to be treated, relatively large axial discharge openings are necessary, for example, in the region of the mixed partial stream or in the region of the dispersed partial stream.

In the mode of execution according to the invention, the entire process of wetting of the powder and subsequent homogenization of the powder or emulsification proceed without any problems and without difficult process-technological measures. In comparison to the conventional systems, this means a considerable gain in time or increase in the quality and increase in the reliability of production. This applies especially to emulsions, the stability of which frequently cannot be predetermined.

An advantageous further development of the invention consists in the fact that the openings for the dispersed partial stream are formed by axially extending slits. This mode of execution makes it possible to have a multiplicity of slits in the direction of rotation of the rotor, as a result of which the dispersing capacity and dispersing effect can be increased. The latter can be improved by providing shearing edges on the edges of the opening and on the rotor blades, which permits fine distribution of the material to be dispersed.

The discharge opening for the mixed partial stream may be designed so that it is variable. It is expedient to design the adjustable closure as a retarding disk.

The recirculation of the media occurs under the influence of the rotating rotor, whereby this influence may depend on the angling of the rotor blades on the centrifugal force or on both.

Instead of or in addition to the measures for influencing the amounts of dispersion work and mixing work (size of the discharge openings, mixing time), it is also possible to vary the angling in the inner and outer regions of the rotor. It is possible to increase or decrease the setting angle from the inside toward the outside even after the material to be treated is present. The particular measure to be used depends on the particular case of application.

In contrast to the conventional mode of execution, in which closing the discharge in the stator results in a decrease of motor current consumption, in the mode of execution according to the invention, the transported stream is deflected and the motor current consumption increases due to the higher output requirement. When the discharge opening for the mixed partial stream is completely closed, which is possible in this invention, as explained before, the motor current consumption is the largest because the highest output is to be provided.

The prescribed advantages of the mode of execution according to the invention, such as the possibility of dispersion while maintaining a relatively high recirculation of the media to be treated, also apply to emulsions, especially to water-in-oil emulsions which become very viscous at the end of the process and require high recirculating output of the system. This high recirculating output cannot be obtained with a pure dispersion system. With the mode of execution of the invention, it is possible to obtain dispersion velocities of 21 m/sec without any difficulty by appropriate dimensioning. This value is generally a minimum value for the production of stable emulsions. Another advantage of a mode of execution of the invention thus lies in the simple handling by the operator. By varying the time of operation, he can influence the degree of dispersion or the stability of the emulsion significantly without changing any constructional components of the machine.

An alternative measure for changing the size of the discharge opening consists in changing the distance between the device and the bottom of the container in which the device is operated with the media to be treated. As this distance is decreased, the size of the discharge opening for the mixed partial stream also decreases. When the bottom of the device rests on the bottom of the container, the discharge opening is completely closed so that the entire stream is being dispersed. With increasing distance from the bottom of the container, the amount of dispersion can be reduced again.

A device for the measure described above can be of a simple construction in this invention. It comprises a stand that can be supported on the container or on another revetment, for example, on the ground that carries the container, this stand having a holding device for the device according to the invention, whereby the holding device can be displaced axially to the device according to the invention and can be secured in the particular position on or in the stand.

Preferred practical examples of the invention will be described below in more detail with the aid of a simplified drawing. The following are shown:

Figure 1:
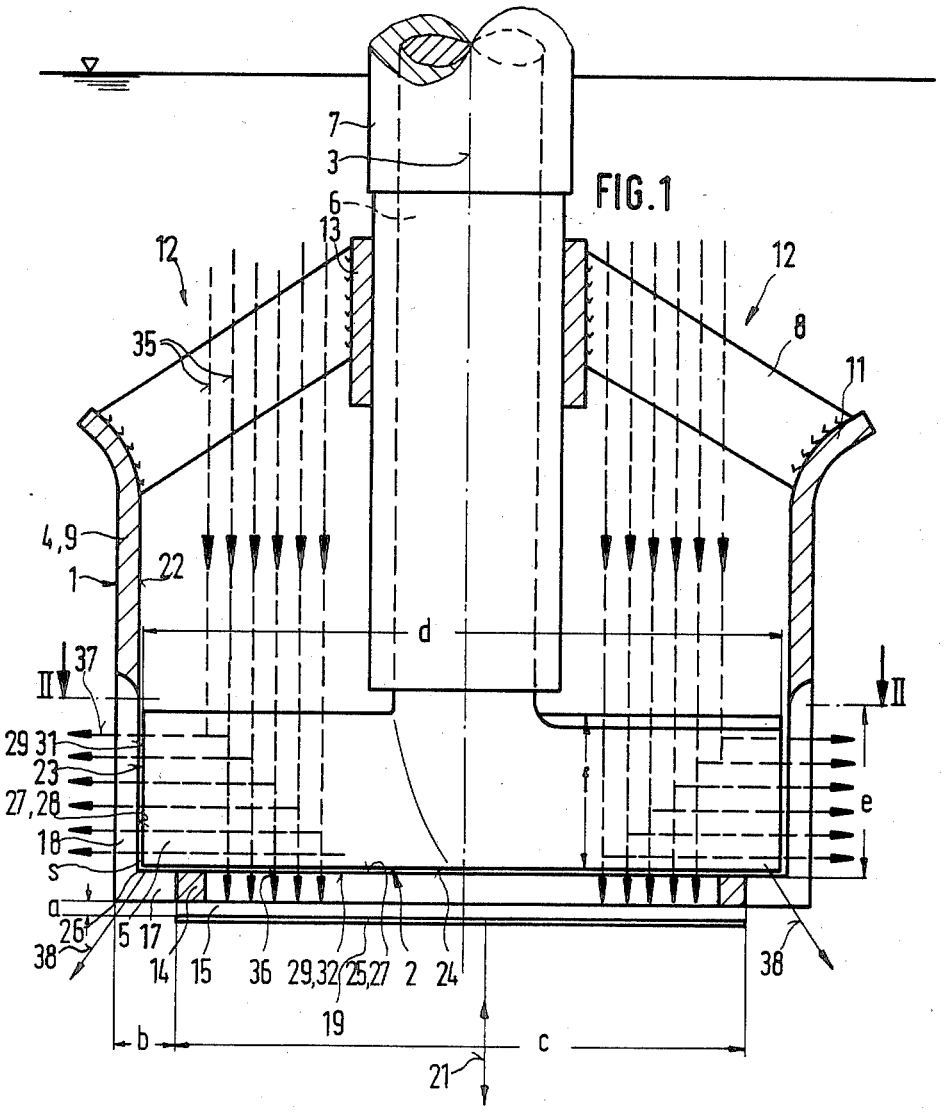
FIG. 1 is a device designed according to the invention for the mixing and dispersion of at least two media, in a vertical cross-section, as the first practical example.

The device, which is generally designated by 1 in the figures, consists of a rotor, which is generally designated by 2, this rotor being located rotatably around a rotary axis 3 in a tubular stator 4. Rotor 2 has a multiplicity of radially extending rotor blades 5 and is secured on a vertically positioned drive shaft 6, which is arranged within a protective tube 7 that holds stator 4 and is connected to it with the aid of radially extending struts 8.

Stator 4 consists of a vertically arranged tube 9, which is widened on the top in the shape of a trumpet and delimits with these edges 11 an inlet for the materials to be treated, this inlet generally being designated by 12. The struts 8 traverse this inlet 12 and connect tube 9 with a sleeve 13 that is secured on protective tube 7.

On the side away from inlet 12, tube 9 of stator 4 is drawn in the form of a radially extending annular wall 14, which surrounds discharge 15. The hollow cylindrical wall section of tube 9 and annular wall 14 form a corner or inner shoulder of stator 4, where rotor 2 is arranged.

In the region of rotor 2, there are radial slits 16 in tube 9, these slits extending along the axis of rotation 3 and extending by an amount designated by b into annular wall 14. Thus, slits 16 have a radial and an axial section 17, 18.

Below discharge 15, there is a retarding disk 19, which can be displaced axially in a manner not shown, and which can be secured in a particular position. The manner in which retarding disk 19 can be adjusted is shown by double arrow 21. By displacing retarding disk 19, one can adjust its distance a from annular wall 14, namely, between a maximum value not shown and the emplacement on annular wall 14, where the annular gap is no longer present, that is, discharge 15 is closed.

The diameter d of rotor 2 must be chosen so that there is only a small gap s between the inner wall 22 of tube 9 and the lateral surface 23 of rotor 2. This gap s also extends between side 24 of the rotor, the side that is facing discharge 15 and inside 25 of annular wall 14. Thus, a shearing field, generally designated with 26, is created between inner wall 22 as well as inside 25 of stator 4 and lateral wall 23 as well as side 24 of rotor 2; shearing edges 27 of this shearing field on the stator side are formed by the inner edges 28 and the shearing edges 29 of this shearing field on the rotor side are formed by the outer edges 31 and side edges 32 of rotor 2.

Figure 2:
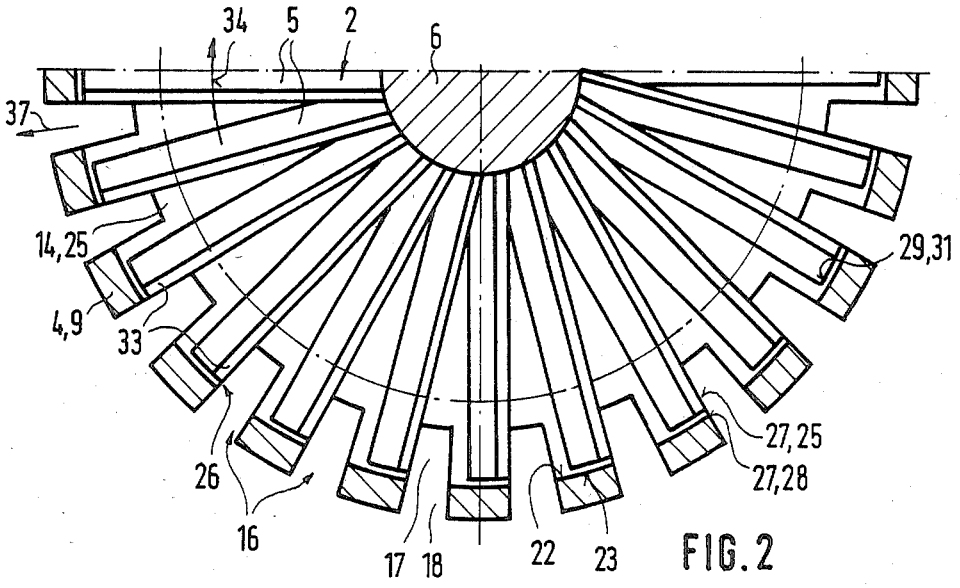
FIG. 2 is a partial cross-section along II-II in FIG. 1.

The rotor blades 5 are angled. This can be seen on the inclined side surfaces which are designated by 33 in FIG. 2. Due to the angling of rotor blades 5 of rotor 2 rotating in the direction of arrow 34 during operation, the material to be treated, consisting of at least two different substances or media, will be aspirated through inlet 12 into stator 4 in the direction of arrow 35. In the region of rotor 2, the material is mixed intimately and, due to two different feed forces, it is divided into an axial partial stream, generally designated with 36, and a radial partial stream, generally designated with 37. The partial streams are marked with radial and axial arrows.

Axial partial stream 36 is an annular stream and it is due to axial feed or acceleration forces which are produced as a result of the angling of rotor blades 5.

Radial partial stream 37 spreads out on the entire periphery of stator 4 and is due to feed or acceleration forces which are produced by the centrifugal force of the parts of the material rotating with rotor 2.

The materials in axial partial stream 36 are mainly mixed intensely with one another while the materials in radial partial stream 37 undergo severe shearing and rebounding action in shearing field 26, as a result of which the desired dispersion and emulsification is achieved. The amount of dispersion work in radial partial stream 37 can be controlled by appropriate dimensioning of the distance a between retarding disk 19 and annular wall 14. When a relatively high recirculating output is desired for the inlet stream (arrows 35), distance a, which determines the cross-section of discharge 15, should be chosen to be relatively large. For example, this is the case when light substances must be incorporated, for example, powders where a relatively large suction effect is needed in order to be able to pull in the material to be treated from the surface downward into the region of the stator.

When retarding disk 19 is completely closed, the entire stream undergoes dispersion. The entire material stream leaves radially through slits 16, whereupon it is subjected to the abovementioned shearing and rebounding actions in shearing field 26. Since the diameter of retarding disk 19 corresponds approximately to the radial distance c between the axial slit sections 18, especially in the completely closed position of retarding disk 19, a downward slanting component of radial partial stream 37 is produced, as indicated by arrows designated with 38. As a result of this, the distribution of the radially dispersed partial stream 37 is improved significantly. In addition, as a result of the radial sections 17 of slit 16, shearing field 26 is considerably enlarged, which is what one aims for in order to obtain efficient distribution of the substances to be dispersed.

Figure 3:
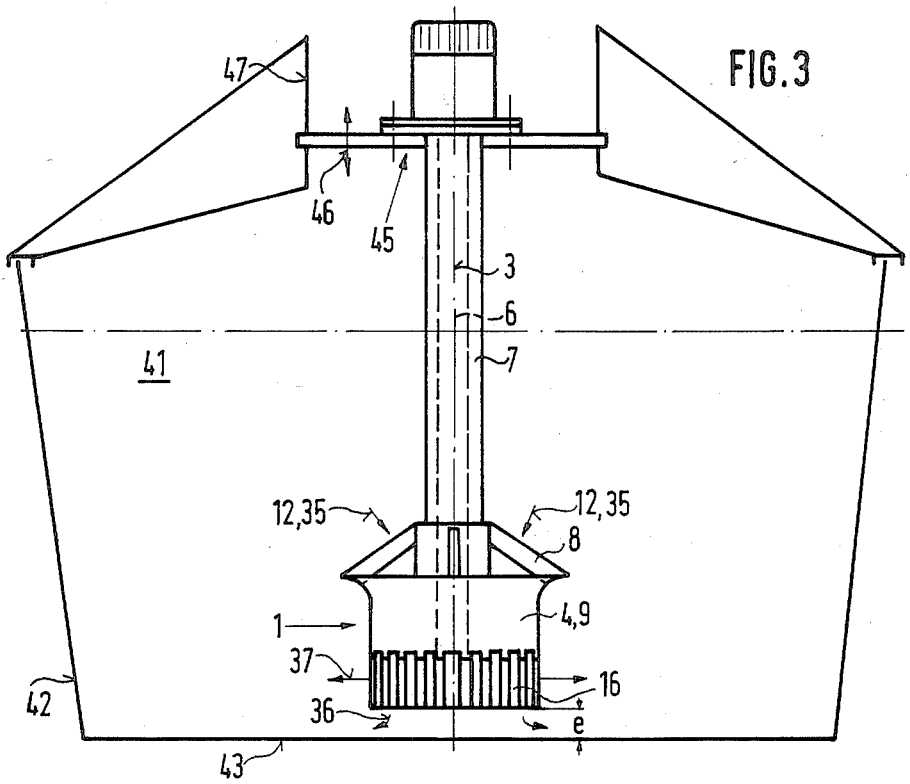
FIG. 3 is a second practical example of the device with a holding device for the axial displacement of the device in a container.

The second practical example according to FIG. 3 differs from the one described above only by the fact that retarding disk 19 is not present. In this practical example, in which device 1 is immersed into the material to be treated, 41, consisting of two different media, for example, water and oil, this material being located in container 42, device 1 is displaced against bottom 43 of container 42 axially, in order to control the desired amount of dispersing and mixing work. The larger the distance e between the bottom of device 1 and bottom 43, the smaller the radial partial stream 37 or the amount of dispersion work. However, above a given distance e, the amounts of dispersion work and mixing work no longer change. The amount of dispersion work is also determined by the size or length 1 of slit 16. In the present practical examples, length 1 corresponds to width f of rotor 2.

If device 1 is completely pushed against bottom 43, so that distance e becomes zero, then discharge 15 is completely closed and full stream dispersion occurs as in the first practical example when retarding disk 19 closes discharge 15 completely.

The axial displacement of device 1 is done expediently with the aid of the holding device 45 that carries it, which can be displaced vertically (double arrow 46) in a guide 47 with the aid of a positioning element which is not shown. For example, the positioning element can be a pneumatically or hydraulically operated positioning cylinder.

I claim:

1. Apparatus for the mixing and dispersion of at least two media, comprising:

a stator of substantially tubular form and having an axis;

a substantially axial inlet to the interior of said stator;

a substantially axial discharge opening for the interior of said stator and spaced from said inlet;

a rotor rotatable about said axis and disposed within said stator between said inlet and said discharge opening, said rotor having a plurality of generally radially extending blades;

a generally radially inward directed shoulder on said stator and extending about said discharge opening; and a plurality of radial openings located circumferentially about said stator just radially outward of said blades and separatd from said discharge opening by said shoulder.

2. The apparatus of claim 1 wherein said radial openings include radially inward directed extensions in said shoulder.

3. The apparatus of claim 3 wherein said radial openings have edges opposed to the intended direction of rotation of said rotor and said blades have shearing edges in close adjacency thereto to define a shearing field.

4. The apparatus of claim 2 wherein said radial inward directed extensions are defined by radially inward directed slits.

5. An apparatus according to claim 1 further including a closure for said discharge opening.

6. An apparatus according to claim 5 wherein said closure is defined by a disc.

7. An apparatus according to claim 5 wherein said closure element comprises the wall of a container in which said stator is movably mounted.

8. An apparatus according to claim 1 wherein said blades are angled, and the angles thereof vary from the inner radial and outer radial portions of the blades.

9. The apparatus of claim 1 wherein said radial openings are defined by axially extending slits.

10. The apparatus of claim 1 wherein said rotor is mounted on a shaft and further including a tubular journal located on said axis and rotatably receiving said shaft, and a plurality of radially directed struts interconnecting said journal and said stator.

* * * * *